US011035180B2

(12) United States Patent
Zou et al.

(10) Patent No.: US 11,035,180 B2
(45) Date of Patent: Jun. 15, 2021

(54) MECHANICAL-HYDRAULIC INTEGRATED RELEASING DEVICE

(71) Applicant: CHINA PETROLEUM & CHEMICAL CORPORATION LTD., Beijing (CN)

(72) Inventors: Wei Zou, Xinjiang Uygur Autonomous Regio (CN); Menghua Zhang, Xinjiang Uygur Autonomous Regio (CN); Lian Liu, Xinjiang Uygur Autonomous Regio (CN); Bowei Wang, Xinjiang Uygur Autonomous Regio (CN); Lingyun Fan, Xinjiang Uygur Autonomous Regio (CN); Jin Xie, Xinjiang Uygur Autonomous Regio (CN); Shengfu Zhou, Xinjiang Uygur Autonomous Regio (CN); Wenxia Li, Xinjiang Uygur Autonomous Regio (CN); Kun Yang, Xinjiang Uygur Autonomous Regio (CN)

(73) Assignee: CHINA PETROLEUM & CHEMICAL CORPORATION LTD., Beijing (CN)

( * ) Notice: Subject to any disclaimer, the term of this patent is extended or adjusted under 35 U.S.C. 154(b) by 0 days.

(21) Appl. No.: 16/345,500

(22) PCT Filed: Oct. 28, 2016

(86) PCT No.: PCT/CN2016/103780

§ 371 (c)(1),
(2) Date: Apr. 26, 2019

(87) PCT Pub. No.: WO2018/076282

PCT Pub. Date: May 3, 2018

(65) Prior Publication Data

US 2019/0271197 A1 Sep. 5, 2019

(51) Int. Cl.
*E21B 17/06* (2006.01)
*E21B 23/00* (2006.01)

(52) U.S. Cl.
CPC ..... *E21B 17/06* (2013.01); *E21B 23/00* (2013.01)

(58) Field of Classification Search
CPC combination set(s) only.
See application file for complete search history.

(56) References Cited

U.S. PATENT DOCUMENTS 1,943,326 A * 1/1934 Kocher ..... F16N 27/005 138/41
3,434,744 A * 3/1969 Paterson ..... F16L 19/12 285/52

(Continued)

FOREIGN PATENT DOCUMENTS

CN 201078206 Y 6/2008
CN 201262045 Y 6/2009

(Continued)

OTHER PUBLICATIONS

International Search Report for PCT Application No. PCT/CN2016/103780, dated Jun. 1, 2017 in 4 pages.

*Primary Examiner* — Cathleen R Hutchins
*Assistant Examiner* — Ronald R Runyan
(74) *Attorney, Agent, or Firm* — Knobbe, Martens, Olson & Bear, LLP

(57) ABSTRACT

A mechanical-hydraulic integrated releasing device includes an upper joint, a lower joint and a pawl. The upper joint and the lower joint are respectively connected to two ends of the pawl. An outer side of the pawl is sleeved with a releasing sleeve capable of moving in an axial direction of the pawl. A step is arranged on an outer wall of a ratchet of the pawl. A groove matching the step is arranged on an inner wall of the releasing sleeve, and the step and the groove cooperate (Continued)

to limit the pawl. A releasing sleeve upper portion is arranged between the releasing sleeve and the upper joint, one end of the releasing sleeve upper portion is inserted into the releasing sleeve, and the other end is sleeved on an outer portion of the upper joint and connected to the upper joint via a start pin.

8 Claims, 1 Drawing Sheet

(56) References Cited

U.S. PATENT DOCUMENTS

| | | | | |
|---|---|---|---|---|
| 4,393,929 | A * | 7/1983 | Akkerman | E21B 33/1295 166/120 |
| 4,441,559 | A * | 4/1984 | Evans | E21B 33/1295 166/120 |
| 7,426,964 | B2 * | 9/2008 | Lynde | E21B 17/06 166/377 |
| 2010/0096123 | A1 | 4/2010 | Hueston et al. | |

FOREIGN PATENT DOCUMENTS

| | | | |
|---|---|---|---|
| CN | 203742500 | U | 7/2014 |
| CN | 105019846 | A | 11/2015 |
| CN | 106545306 | A | 3/2017 |

* cited by examiner

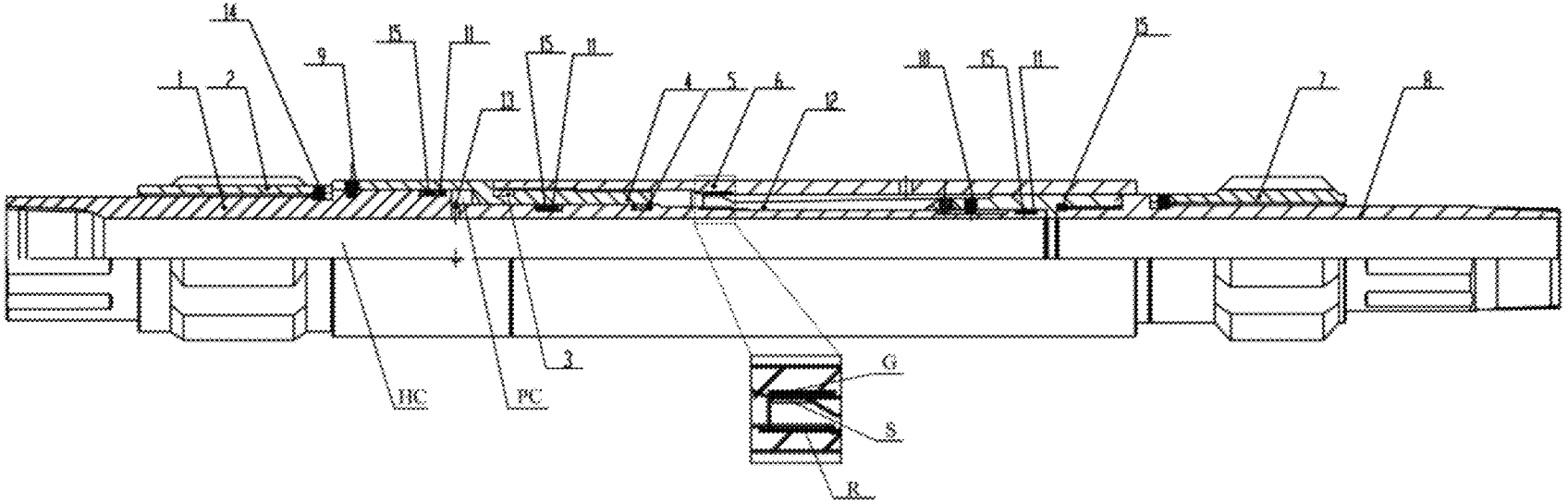

MECHANICAL-HYDRAULIC INTEGRATED RELEASING DEVICE

CROSS-REFERENCE TO RELATED APPLICATIONS

This application is the U.S. National Phase under 35. U.S.C. § 371 of International Application PCT/CN2016/103780, filed Oct. 28, 2016. The disclosures of the above-described application are hereby incorporated by reference in their entirety.

FIELD OF TECHNOLOGY

The present disclosure relates to the technical field of oil field production, and particularly to a mechanical-hydraulic integrated releasing device, and more particularly to a safety releasing joint used in a completion pipe string of an oil-gas well.

BACKGROUND

The function of a safety releasing joint used in a completion pipe string of an oil-gas well is to lift the upper portion of the completion pipe string in the position of the safety releasing device when the lower portion of the pipe string is stuck and cannot be lifted, so as to reduce losses and provide convenience to later works.

At present, there are mainly two types of safety releasing joints used during completion: one is the mechanical releasing device, safety releasing devices of this type have the advantages of convenient operation, high reliability, and large tool diameter, etc., but the tension resistance thereof is poor. As a result, once an obstruction or a jamming occurs when releasing the completion pipe string, it is prone to release in advance due to improper operations. The other type is the hydraulic releasing device. The safety releasing devices of this type have a strong tension resistance, therefore accidents are not easy to occur when releasing the completion pipe string. However, it needs to perform pitching and pressing operations that are complicated and not reliable. At the same time, there are generally reduced diameters inside the hydraulic releasing device, which is easy to bring inconvenience to later constructions.

SUMMARY

(I) Technical Problem to be Solved

The technical problem to be solved by the present disclosure is to provide a mechanical-hydraulic integrated releasing device, which effectively combines the mechanical releasing device and the hydraulic releasing device, and solves the problems that a mechanical releasing device is poor in resistance to tension and the reliability of a hydraulic releasing device is not high in the prior art.

(II) Technical Solutions

In order to solve the technical problems above, the present disclosure provides a mechanical-hydraulic integrated releasing device, including an upper joint, a lower joint and a pawl; wherein the upper joint and the lower joint are respectively connected to two ends of the pawl; an outer side of the pawl is sleeved with a releasing sleeve capable of moving in an axial direction of the pawl, a step is arranged on an outer wall of a ratchet of the pawl, a groove matching the step is arranged on an inner wall of the releasing sleeve, and the step and the groove cooperate to limit the pawl; a releasing sleeve upper portion is arranged between the releasing sleeve and the upper joint, one end of the releasing sleeve upper portion is inserted into the releasing sleeve, and the other end is sleeved on an outer portion of the upper joint and connected to the upper joint via a start pin; and a pressure cavity is formed between the upper joint and the releasing sleeve upper portion, a hydraulic cavity is arranged in the upper joint, and two pressure transmission holes, which are in communication with the pressure cavity, are symmetrically arranged on a side wall of the hydraulic cavity in a radial direction.

Further, an outer wall of the upper joint is bounded by the pressure transmission holes such that an outer diameter of an end of the upper joint away from the releasing sleeve is greater than that of the other end; outer walls on both sides of the pressure transmission holes and an inner wall of the releasing sleeve upper portion constitute the pressure cavity, and first sealing structures are respectively arranged on both ends of the pressure cavity.

Further, a retaining ring is arranged between the pawl and the releasing sleeve upper portion; the retaining ring is sleeved on the upper joint, and the retaining ring is connected to the releasing sleeve through a screw thread.

Further, a lock ring for limiting the releasing sleeve upper portion is provided on the upper joint.

Further, a lock groove is provided on an inner wall at a connection of the releasing sleeve upper portion and the retaining ring; when a position of the lock groove corresponds to the lock ring, the lock groove and the lock ring cooperate to axially limit the releasing sleeve upper portion.

Further, the ratchet of the pawl is connected to the upper joint by a toothed engagement with a tooth bearing angle of 35°.

Further, an end of the upper joint close to the lower joint is connected to a pawl hand via a releasing pin, and the lower joint is fixedly connected to the pawl hand.

Further, a second sealing structure is provided between the end of the upper joint close to the lower joint and the pawl hand.

Further, an end portion of the upper joint is sleeved with an upper end centralizer, and the upper joint is connected to the upper end centralizer via a screw thread.

Further, an end portion of the lower joint is sleeved with a lower end centralizer, and the lower joint is connected to the lower end centralizer via a screw thread.

(III) Advantageous Effects

The technical solutions of the present disclosure above have the following advantageous effects:

The present disclosure provides a mechanical-hydraulic integrated releasing device, wherein an outer side of the pawl is sleeved with a releasing sleeve capable of moving in an axial direction of the pawl, and a step on an outer wall of a ratchet of the pawl can cooperate with a groove on an inner wall of the releasing sleeve to limit the pawl, so that the pawl cannot be opened under the pulling force, which improves the tensile resistance of the releasing device. Therefore the upper joint and the lower joint are connected by the pawl, and the releasing device will not release accidentally when accidental jamming occurs during the release of the completion pipe string.

The present disclosure provides a mechanical-hydraulic integrated releasing device, wherein a releasing sleeve upper portion is arranged between the releasing sleeve and the upper joint, one end of the releasing sleeve upper portion is inserted into the releasing sleeve, and the other end is sleeved on an outer portion of the upper joint and connected to the upper joint via a start pin; and a pressure cavity is formed between the upper joint and the releasing sleeve upper portion, a hydraulic cavity is arranged in the upper joint, and two pressure transmission holes, which are in communication with the pressure cavity, are symmetrically arranged on a side wall of the hydraulic cavity in a radial direction, and thus the upper joint and the lower joint are connected by only the pawl and a releasing pin is not subjected to force when the releasing device is releasing the completion pipe string. After the completion pipe string is in place, there is a pressure difference inside and outside the oil pipe due to the set packer or the acid fracturing construction. Therefore, the releasing device can cut off the start pin with the piston force generated by the pressure difference, so that the releasing sleeve moves towards the lower joint. As a result, the pawl is disabled in releasing, and the upper joint and the lower joint of the safety releasing device are connected via only the pin. If the lower pipe string is jammed when building the upper pipe string, and the lifting tonnage reaches the set cutting value of the releasing pin, the pin is cut off so that the upper joint and the lower joint are separated and the upper pipe string can be lifted smoothly.

BRIEF DESCRIPTION OF THE DRAWINGS

FIG. 1 is a specific structural diagram of the mechanical-hydraulic integrated releasing device of the present disclosure.

Wherein, 1: upper joint; 2: upper end centralizer; 3: releasing sleeve upper portion; 4: retaining ring; 5: lock ring; 6: releasing sleeve; 7: lower end centralizer; 8: lower joint; 9: start pin; 10: releasing pin; 11: sealing support ring; 12: pawl; 13: pressure transmission hole; 14: retaining screw; 15: O-shaped sealing ring.

DETAILED DESCRIPTION

The implementation manners of the present disclosure are further described in detail with reference to the accompanying drawing and embodiments. The following embodiments are used to illustrate the present disclosure, but cannot limit the scope thereof.

In the description of the present disclosure, it should be noted that unless defined otherwise, "a plurality of" means two or more; the orientation or position relations indicated by the terms "upper", "lower", "left", "right", "inside", "outside", "front end", "rear end", "head portion", "tail portion" etc. are based on the orientation or position relations shown in the drawing, which is merely for the convenience of describing the present disclosure and simplifying the description, and is not to indicate or imply that the device or element referred to must have a specific orientation or is constructed and operated in a specific orientation. Therefore, it cannot be construed as limiting the present disclosure. In addition, the terms "first", "second" and "third" etc. are only for the purpose of description, and cannot be construed as indicating or implying the relative importance.

As shown in FIG. 1, the present embodiment provides a mechanical-hydraulic integrated releasing device, including an upper joint 1, a lower joint 8 and a pawl 12. The upper joint 1 and the lower joint 8 are respectively connected to two ends of the pawl 12. An outer side of the pawl 12 is sleeved with a releasing sleeve 6 capable of moving in an axial direction of the pawl 12. A step S is arranged on an outer wall of a ratchet R of the pawl 12, a groove G matching the step S is arranged on an inner wall of the releasing sleeve 6, and the step S and the G groove cooperate to limit the pawl 12; that is, the step S is completely in contact with a reduced diameter portion on the inner wall of the releasing sleeve 6, so that the pawl 12 cannot be opened under the pulling force, which improves the tensile resistance of the releasing device and enhances the reliability of the releasing device. Therefore the releasing device will not release accidentally once an accidental jamming occurs when the releasing device is releasing the completion pipe string.

A releasing sleeve upper portion 3 is arranged between the releasing sleeve 6 and the upper joint 1, one end of the releasing sleeve upper portion 3 is inserted into the releasing sleeve 6, and the other end is sleeved on an outer portion of the upper joint 1 and connected to the upper joint 1 via a start pin 9. A pressure cavity PC is formed between the upper joint 1 and the releasing sleeve upper portion 3. To be specific, an outer wall of the upper joint 1 is bounded by pressure transmission holes 13 such that an outer diameter of an end of the upper joint 1 away from the releasing sleeve 6 is larger than that of an end of the upper joint 1 close to the releasing sleeve 6, and the outer wall of the upper joint 1 is formed in a stepped shape. Therefore a recessed area formed by outer walls on both sides of the pressure transmission holes 13 and a recessed area of the inner wall of the releasing sleeve upper portion 3 constitute the pressure cavity PC, and first sealing structures are respectively arranged on both ends of the pressure cavity PC. The first sealing structures on both ends of the pressure cavity PC are respectively arranged on the end of the upper joint 1 away from the releasing sleeve 6, and between the end of the upper joint 1 close to the releasing sleeve 6 and the releasing sleeve upper portion 3. In the present embodiment, the first sealing structure comprises a sealing support ring 11 and an O-shaped sealing ring 15, and is sealed in combination.

A hydraulic cavity HC is arranged within the upper joint 1, and two pressure transmission holes 13, which are in communication with the pressure cavity PC, are symmetrically arranged on a side wall of the hydraulic cavity HC in the radial direction, so that the pressure between the hydraulic cavity HC and the pressure cavity PC communicates. Therefore the pressure, generated in the pressure cavity PC when the releasing device presses, is transferred into the hydraulic cavity HC through the pressure transmission holes 13.

A retaining ring 4 is arranged between the pawl 12 and the releasing sleeve upper portion 3. The retaining ring 4 is sleeved on the upper joint 1, and the retaining ring 4 is connected to the releasing sleeve 6 through a screw thread to protect the pawl 12 from being damaged due to the excessive movement of the releasing sleeve upper portion 3.

A lock ring 5 for limiting the releasing sleeve upper portion 3 is provided on the upper joint 1. As shown in FIG. 1, a lock groove is provided on an inner wall at a connection of the releasing sleeve upper portion 3 and the retaining ring 4. When a position of the lock groove corresponds to the lock ring 5, the lock groove and the lock ring 5 cooperate to axially limit the releasing sleeve upper portion 3, that is, when the lock groove goes down to a position of the lock ring 5 along with the releasing sleeve upper portion 3 and the retaining ring 4, the lock ring 5 is bounced into the groove, and the releasing sleeve upper portion 3 and the upper joint 1 are locked, so that they cannot continue to move up and down.

The ratchet R of the pawl 12 is connected to the upper joint 1 by a toothed engagement with a tooth bearing angle of 35°. When an internal pressure of the releasing device is greater than an external pressure of the releasing device by a certain value, the start pin 9 is cut off, the releasing sleeve 6 descends, the pawl 12 is disabled, the ratchet R of the pawl 12 stretches, and the upper joint 1 is connected to a pawl hand via only a releasing pin 10 arranged on the end of the upper joint 1 close to the lower joint 8. At this point, once the tension applied to both ends of the upper joint 1 and the lower joint 8 reaches a cutting value of the releasing pin 10, the releasing pin 10 will be cut off so that the upper joint 1 and the lower joint 8 are disengaged. In addition, the lower joint 8 is fixedly connected to the pawl hand such that the pawl 12 is always connected to the lower joint 8. An O-shaped sealing ring 15 for sealing is provided between the lower joint 8 and the pawl 12.

A second sealing structure is provided between the end of the upper joint 1 close to the lower joint 8 and the pawl hand. In the present embodiment, the second sealing structure comprises a sealing support ring 11 and an O-shaped sealing ring 15, and is sealed in combination.

An end portion of the upper joint 1 is sleeved with an upper end centralizer 2, and the upper joint 1 and the upper end centralizer 2 are connected via a screw thread. An end portion of the lower joint 8 is sleeved with a lower end centralizer 7, and the lower joint 8 and the lower end centralizer 7 are connected via a screw thread. The upper end centralizer 2 and the lower end centralizer 7 act so as to right the entire releasing device. Retaining screws 14 are also provided between the upper end centralizer 2 and the upper joint 1, and between the lower end centralizer 7 and the lower joint 8.

The start pin 9 and the releasing pin 10 can also be arranged flexibly in use according to actual conditions of the well. The buckle type of both ends of the upper joint 1 and the lower joint 8 are 2-7/8EUE, and the buckle type can be processed into other types as needed. An inner diameter of the hydraulic cavity HC is 62 mm, and an interior of the hydraulic cavity HC is smooth and provided with no steps and reduced diameters.

The operating principle of the present embodiment is: the upper joint 1 and the lower joint 8 are connected by the pawl 12, and the releasing pin 10 is not subjected to force when entering the well; after the completion pipe string is in place, there is a pressure difference inside and outside the oil pipe due to the set packer or the acid fracturing construction, and therefore a pressure is generated inside the releasing device and enters the pressure cavity PC through the pressure transmission holes 13. Since the inner upper end surface of the releasing sleeve upper portion 3 has a smaller piston area than the lower end surface, the releasing sleeve upper portion 3 is subjected to a downward resultant force. When the resultant force reaches the cutting value of the start pin 9, the start pin 9 is cut off, and the retaining ring 4 which is integrally connected with the releasing sleeve 6 by the screw thread descends together with the releasing sleeve 6. The inner diameter of the upper end of the releasing sleeve 6 is large, and it is impossible to continue to hold up the step S of the pawl 12 after descending, so that the pawl 12 is bounced and fails to be connected to the upper joint 1. When the lock groove descends to the position of the lock ring 5, the lock ring 5 is bounced into the lock groove, and the releasing sleeve upper portion 3 and the upper joint 1 are locked, so that they cannot continue to move up and down. The upper joint 1 and the lower joint 8 are connected by only the releasing pin 10 in the case that the pawl 12 fails. When the tension received by the upper joint 1 and the lower joint 8 reaches the cutting value of the releasing pin 10, the pin is cut off, and the upper joint 1 and the lower joint 8 are disengaged so as to complete the releasing operation.

The embodiments of the present disclosure are presented for the purposes of illustration and description, and are not intended to be exhaustive or to limit the present disclosure to the disclosed forms. Many modifications and variations are obvious to the person of ordinary skills in the art. The embodiments are chosen and described in order to better illustrate the principles and practical applications of the present disclosure, and to make the person of ordinary skills in the art to appreciate the present disclosure so as to design various embodiments with various modifications and suitable for specific uses.

What is claimed is:

1. A mechanical-hydraulic integrated releasing device, comprising an upper joint, a lower joint and a pawl; wherein the upper joint and the lower joint are respectively connected to two ends of the pawl; an outer side of the pawl is sleeved with a releasing sleeve capable of moving in an axial direction of the pawl, a step is arranged on an outer wall of a ratchet of the pawl, a groove matching the step is arranged on an inner wall of the releasing sleeve, and the step and the groove cooperate to limit the pawl; a releasing sleeve upper portion is arranged between the releasing sleeve and the upper joint, one end of the releasing sleeve upper portion is inserted into the releasing sleeve, and the other end is sleeved on an outer portion of the upper joint and connected to the upper joint via a start pin; and a pressure cavity is formed between the upper joint and the releasing sleeve upper portion, a hydraulic cavity is arranged in the upper joint, and two pressure transmission holes disposed in the upper joint, which are in communication with the pressure cavity, are symmetrically arranged on a side wall of the hydraulic cavity in a radial direction; an outer diameter of an end of the upper joint away from the releasing sleeve is greater than that of the other end and the pressure transmission holes are disposed in a region of the upper joint where an outer diameter is smaller than that of the end of the upper joint away from the releasing sleeve; the area where the pressure transmission holes are disposed and an inner wall of the releasing sleeve upper portion constitute the pressure cavity, and first sealing structures are respectively arranged on both ends of the pressure cavity; a retaining ring is arranged between the pawl and the releasing sleeve upper portion; the retaining ring is sleeved on the upper joint, and the retaining ring is connected to the releasing sleeve through a screw thread.

2. The mechanical-hydraulic integrated releasing device of claim 1, wherein a lock ring for limiting the releasing sleeve upper portion is provided on the upper joint.

3. The mechanical-hydraulic integrated releasing device of claim 2, wherein a lock groove is provided on an inner wall at a connection of the releasing sleeve upper portion and the retaining ring; when a position of the lock groove corresponds to the lock ring, the lock groove and the lock ring cooperate to axially limit the releasing sleeve upper portion.

4. The mechanical-hydraulic integrated releasing device of claim 1, wherein the ratchet of the pawl is connected to the upper joint by a toothed engagement with a tooth bearing angle of 35°.

5. The mechanical-hydraulic integrated releasing device of claim 4, wherein an end of the upper joint close to the lower joint is connected to a pawl hand via a releasing pin, and the lower joint is fixedly connected to the pawl hand.

6. The mechanical-hydraulic integrated releasing device of claim 5, wherein a second sealing structure is provided between the end of the upper joint close to the lower joint and the pawl hand.

7. A mechanical-hydraulic integrated releasing device comprising an upper joint, a lower joint and a pawl; wherein the upper joint and the lower joint are respectively connected to two ends of the pawl; an outer side of the pawl is sleeved with a releasing sleeve capable of moving in an axial direction of the pawl, a step is arranged on an outer wall of a ratchet of the pawl, a groove matching the step is arranged on an inner wall of the releasing sleeve, and the step and the groove cooperate to limit the pawl; a releasing sleeve upper portion is arranged between the releasing sleeve and the upper joint, one end of the releasing sleeve upper portion is inserted into the releasing sleeve, and the other end is sleeved on an outer portion of the upper joint and connected to the upper joint via a start pin; and a pressure cavity is formed between the upper joint and the releasing sleeve upper portion, a hydraulic cavity is arranged in the upper joint, and two pressure transmission holes disposed in the upper joint, which are in communication with the pressure cavity, are symmetrically arranged on a side wall of the hydraulic cavity in a radial direction, wherein an end portion of the upper joint is sleeved with an upper end centralizer, and the upper joint is connected to the upper end centralizer via a screw thread.

8. A mechanical-hydraulic integrated releasing device comprising an upper joint, a lower joint and a pawl; wherein the upper joint and the lower joint are respectively connected to two ends of the pawl; an outer side of the pawl is sleeved with a releasing sleeve capable of moving in an axial direction of the pawl, a step is arranged on an outer wall of a ratchet of the pawl, a groove matching the step is arranged on an inner wall of the releasing sleeve, and the step and the groove cooperate to limit the pawl; a releasing sleeve upper portion is arranged between the releasing sleeve and the upper joint, one end of the releasing sleeve upper portion is inserted into the releasing sleeve, and the other end is sleeved on an outer portion of the upper joint and connected to the upper joint via a start pin; and a pressure cavity is formed between the upper joint and the releasing sleeve upper portion, a hydraulic cavity is arranged in the upper joint, and two pressure transmission holes disposed in the upper joint, which are in communication with the pressure cavity, are symmetrically arranged on a side wall of the hydraulic cavity in a radial direction, wherein an end portion of the lower joint is sleeved with a lower end centralizer, and the lower joint is connected to the lower end centralizer via a screw thread.

* * * * *